United States Patent [19]

Lay et al.

[11] Patent Number: 4,501,037

[45] Date of Patent: Feb. 26, 1985

[54] METHOD FOR INTRODUCING HEAT-SENSITIVE MATERIAL INTO A HOT ENVIRONMENT

[75] Inventors: Khin M. Lay, Gardena; Stephen E. Palguta, Redondo Beach; Ramon B. Fernandez, Torrance; Santiago C. Cabalquinto, Lawndale, all of Calif.

[73] Assignee: Hitco, Newport Beach, Calif.

[21] Appl. No.: 483,922

[22] Filed: Apr. 11, 1983

[51] Int. Cl.[3] ..... D06B 3/12; D06B 23/04

[52] U.S. Cl. ..... 8/149.2; 29/526 R; 68/2; 68/5 D; 156/157; 226/92; 423/447.4; 423/447.6; 432/8

[58] Field of Search ..... 226/92; 423/447.1, 447.4, 423/447.6; 264/29.2; 156/157; 29/526 R; 34/162; 432/5, 8, 59; 8/149.2, 149.3; 68/2, 5 D, 5 E; 474/256, 257; 24/31 B

[56] References Cited

U.S. PATENT DOCUMENTS

| | | | |
|---|---|---|---|
| 3,127,079 | 3/1964 | Allander | 226/92 |
| 3,399,465 | 9/1968 | Lanne et al. | 34/162 X |
| 4,048,277 | 9/1977 | Breznak et al. | 264/29.2 X |
| 4,100,004 | 7/1978 | Moss et al. | 264/29.2 X |
| 4,239,367 | 12/1980 | Hope et al. | 226/92 X |
| 4,335,089 | 6/1982 | Maruyama et al. | 423/447.6 X |

*Primary Examiner*—Philip R. Coe
*Attorney, Agent, or Firm*—Fraser and Bogucki

[57] ABSTRACT

In a process for continuously pulling a web of tows of carbonizable material under tension through an oxidizing oven, the web is introduced into the oxidizing oven by initially feeding a leader in the form of a web of heat-resistant cloth through the oven and then heating the oven if the oven is not already hot. The trailing edge of the leader which remains outside of the oven is then spliced to the leading edge of the web of carbonizable tows, and the leader is used to pull the web of carbonizable tows into and through the hot oven. Use of the heat-resistant leader greatly minimizes wastage within the web of carbonizable tows. Splicing of the trailing edge of the lead to the leading edge of the web of carbonizable tows is accomplished by taping, stitching and folding the two edges to form loops therein into which elongated rods are inserted. The two edges are then secured within a splice bar, the opposite halves of which define slots for receiving the two edges and the included rods. The splice bar may be removed to uncouple the leading edge of the web of carbonizable tows from the leader after the leading edge has passed through the oxidizing oven.

11 Claims, 11 Drawing Figures

METHOD FOR INTRODUCING HEAT-SENSITIVE MATERIAL INTO A HOT ENVIRONMENT

BACKGROUND OF THE INVENTION

1. Field of the Invention

The present invention relates to the oxidation of polyacrylonitrile or other carbonizable material, and more particularly to oxidation processes in which an elongated web comprised of tows of the carbonizable material is continuously pulled through an oven under tension to accomplish oxidation thereof.

2. History of the Prior Art

It is known to carbonize polyacrylonitrile (PAN) or other carbonizable material by first oxidizing the material and thereafter heating the material in an inert atmosphere to a temperature sufficient to substantially carbonize the material. In the case of PAN, such material is often processed in the form of an elongated web of tows which are disposed in generally parallel, side-by-side fashion along the length of the web formed thereby. The web is fed under tension through relatively complex paths defined by rollers within one or more oxidizing ovens prior to being introduced into a carbonization furnace. Within the oxidizing oven the web makes multiple passes through different stages of the oven maintained at temperatures designed to achieve the desired oxidation of the PAN tows.

The nature of the PAN tows is such that the web cannot be allowed to remain at rest but must be kept continuously moving through the oxidizing oven when the oven is at oxidizing temperatures. To allow the web to remain at rest for any period of time would permit rapid deterioration and possible exotherming of the PAN tows. Moreover, even when the web is kept continuously moving through the oven, there cannot be any loose ends or knots in the tows. If loose ends or knots are present, they will usually exotherm in the hot oven resulting in interruption of the process and frequently the need to shut down the entire process and again introduce the web into the oxidation oven when cool.

For this reason the web of PAN tows is typically introduced into the oxidation oven when the oven is cool. Introduction is accomplished by tying the individual tows to various locations along the length of a threader bar having cables attached to the opposite ends thereof, The cables are used to pull the threader bar and attached tows into and through the oxidizing oven. Because the oven is cool, the knots and loose ends of the tows where they are tied to the threader bar do not exotherm.

When the tows have been pulled completely through the oxidizing oven by the threader bar, the oven is turned on and is heated up to oxidizing temperatures as the web of tows continues to be fed therethrough. The oven normally requires approximately two hours to reach oxidizing temperatures, during which time the web is continuously pulled through the oven. When the oven reaches oxidizing temperatures new portions of the web entering and pulled through the oven are oxidized in the desired manner. The preceding portions of the web which typically comprise about 200 to 400 pounds of PAN tows must be discarded as wastage. Because the PAN tows are relatively expensive, this represents a significant economic disadvantage in terms of the economics of the overall process.

It is seldom practical or for that matter possible to keep processes of this type running on an indefinite basis because of the need to keep personnel present at all times on a round-the-clock basis. In addition, power failures and other interruptions usually result in the need to let the oxidizing oven cool off, following which the startup process described above must be repeated. Accordingly, wastage of substantial quantities of PAN tows has become a routine and necessary part of carrying out such processes.

Because of the need to have a web of material under appropriate tension present within the oxidizing oven in preparation for the oxidation of fresh PAN tows, one technique commonly employed for shutting down the process is to continue running the web through the oven after the oven is turned off until the oven has cooled down sufficiently so that the web can be brought to rest. Upon subsequent startup, movement of the web through the oven is begun as the oven is heated up to oxidizing temperatures. The portions of the web which are run through the oven during the cooling off of the oven and the subsequent turning on thereof must be discarded as wastage.

In some cases the individual tows of the web are severed at the entrance to the oven after the oven has cooled down and the passage of the web therethrough stopped. When this occurs the process may be started by securing the web to be oxidized to the PAN tows residing within the oven. In such instances the individual tows of the web to be introduced into the oven are tied to the individual tows of the web residing within the oven, following which advancement of the webs through the oven is begun. To prevent exotherming of the knots and loose ends where the tows are tied together, the oven is turned on in stages with each stage being turned on after the ties in the tows have cleared that stage. Again, substantial amounts of the PAN tows are wasted before the oven can be brought up to operating temperature so as to begin oxidizing the web in the desired fashion.

Where the web comprises PAN fabric rather than individual tows of PAN material, lengths of the fabric have been joined together using various techniques such as that shown by way of example in U.S. Pat. No. 4,077,822 of Logwin.

It would therefore be advantageous to provide a method of introducing a web of carbonizable tows into an oxidizing oven in such fashion that wastage of the tows is minimized.

BRIEF DESCRIPTION OF THE INVENTION

The present invention provides a method and apparatus for introducing heat-sensitive material such as a web of carbonizable tows into an oven in such a way that wastage of the heat-sensitive material is minimized. In addition, a technique and apparatus are provided for advantageously joining together webs of material such as for use in such process.

According to the invention an elongated web of heat-resistant material of silica, aramid or similar composition comprising a leader is first fed into the oxidizing oven so that the leader passes through the oven with the trailing edge thereof remaining outside of the oven and adjacent the entrance thereto. The trailing edge of the leader is then spliced to the leading edge of a web of carbonizable tows using a splicing technique and apparatus strong enough to withstand the tension on the webs and to allow the splice to be passed through the oven without interference. The leader can be fed into the oven with the oven already heated to oxidizing temperatures. Alternatively, the oven can be turned on and heated to oxidizing temperatures after the leader has been fed into and through the oven and brought to rest. When the splice is completed, the leader is advanced through the oven so as to pull the web of carbonizable tows into and through the oven. Because the oven is heated to oxidizing temperatures prior to introduction of the web of carbonizable tows into the oven, oxidizing of the carbonizable tows in the desired fashion commences upon introduction of the web of tows into the oven and little if any of the web of carbonizable tows is wasted.

In a preferred method according to the invention the leader is advanced through a tension stand and then into and through the oxidizing oven until the trailing edge of the leader has been pulled through the tension stand and remains outside of the oven. The web of carbonizable tows is then pulled at least partly through the tension stand, following which a leading edge is formed in the web at the entrance to the tension stand. Tape of glass or similar composition is applied to the leading edge of the web of tows, following which a cut is made through the tape across the width of the web of tows to remove a small portion of the tape and the small portion of the tows preceding the leading edge. The trailing edge of the leader is then fed back through the tension stand and is spliced to the leading edge of the web of tows at the entrance to the tension stand. Following completion of the splice, the oxidizing oven is heated to oxidizing temperatures if it has not already been heated. Advancement of the leader through the oxidizing oven is again commenced so as to pull the leading edge of the web of tows through the tension stand and then through the oxidizing oven. When the leading edge of the web of tows has passed completely through the oxidizing oven, it may be separated from the trailing edge of the leader so that the web of oxidized tows can be rolled onto a takeup reel or otherwise disposed of at the exit of the oxidizing oven in preparation for carbonization and further processing.

Splicing of the trailing edge of the leader to the leading edge of the web of carbonizable tows may be accomplished by applying pieces of heat-resistant tape to the opposite sides of each of the edges. The portions of the tows in advance of the tape on the web of tows are trimmed away and discarded. Each of the taped edges is then stitched several times along the length thereof and folded over on itself to form a loop therein. An elongated rod is inserted into the loop formed in the trailing edge of the leader and a similar rod is inserted into the loop formed in the leading edge of the web. The edges are then inserted between the opposite halves of a splice bar such that the elongated rods and portions of the edges reside within a pair of slots formed between the opposite halves along the length of the splice bar. The opposite halves of the splice bar are then drawn together so as to tightly secure the edges of the leader and web and the included rods therebetween.

BRIEF DESCRIPTION OF THE DRAWINGS

The foregoing and other objects, features and advantages of the invention will be apparent from the following more particular description of preferred embodiments of the invention, as illustrated in the accompanying drawings, in which.

DETAILED DESCRIPTION

Figure 1:
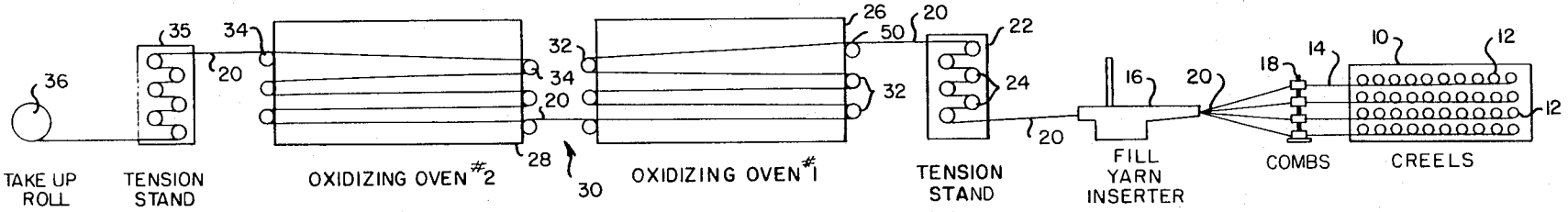
FIG. 1 is a plan view of apparatus used in a process for oxidizing a web of carbonizable tows.

FIG. 1 depicts the apparatus used in a continuous process for oxidizing a web of PAN or other carbonizable tows. The apparatus of FIG. 1 includes a rack 10 mounting a plurality of creels 12 which have tows of carbonizable material wound thereon. In the present example the tows consist of PAN material with each tow being comprised of from 3000 to 12000 filaments depending in part upon how closely the tows are spaced together in the web formed thereby. As seen in FIG. 1 individual tows 14 are unwound from the various creels 12 and are drawn into a fill yarn inserter 16 via an assembly of combs 18. The combs 18 act as guides as the tows 14 are unwound from the creels 12 and pulled into a relatively flat, generally horizontal web 20 at the input to the fill yarn inserter 16. The web 20 has a width which can be as much as 53" and is comprised of as many as 600 of the tows 14.

The fill yarn inserter 16 is operative to interweave a fill yarn with the various tows 14 in order to hold the various tows 14 of the web 20 together for purposes of further processing. An example of the fill yarn inserter 16 is provided by the apparatus shown in U.S. Pat. No. 4,173,990 of Spain et al, which issued on Nov. 13, 1979 and is commonly assigned with the present application. The fill yarn inserted by the fill yarn inserter 16 is typically removed following oxidation and further processing of the web 20 so that the tows 14 can be wound individually or in groups rather than only as part of the entire web 20.

After insertion of the fill yarn, the web 20 is fed into a tension stand 22 comprised of a plurality of spaced-apart rollers 24. Within the tension stand 22 the web 20 follows an alternating path around the various rollers 24 before exiting the tension stand 22 and being fed into a first oxidation oven 26. The tension stand 22 is conventional in design and insures proper tension on the web 20 as the web enters the oxidation oven 26.

The oxidation oven 26 together with a second oxidation oven 28 comprises an oxidation oven assembly 30. Within the first oxidation oven 26 the web 20 follows a relatively tortuous path as it winds around various different rollers 32 mounted at the opposite ends of the oven 26. From the first oven 26 the web 20 is drawn into the second oxidation oven 28 where it again follows a relatively tortuous path as it winds around a plurality of rollers 34 at the opposite ends of the oven 28. While not shown in FIG. 1 the oxidation ovens 26 and 28 are typically divided internally into a plurality of different stages, each of which may be maintained at a temperature somewhat different from the temperatures in the other stages. The rollers 32 and 34 within the ovens 26 and 28 cooperate with the tension stand 22 and a tension stand 35 outside of the exit end of the oven 28 in maintaining a desired tension in the web 20 as the web is drawn through the ovens 26 and 28. At least part of the tension occurs as the result of shrinkage of the PAN material comprising the web 20 as such material is oxidized. At the exit of the second oxidation oven 28 the web 20 is directed through the tension stand 35 and onto a rotating takeup roll 36 where it is stored in preparation for carbonization and further processing. The tension stand 35 is similar in construction to the tension stand 22.

Figure 2:
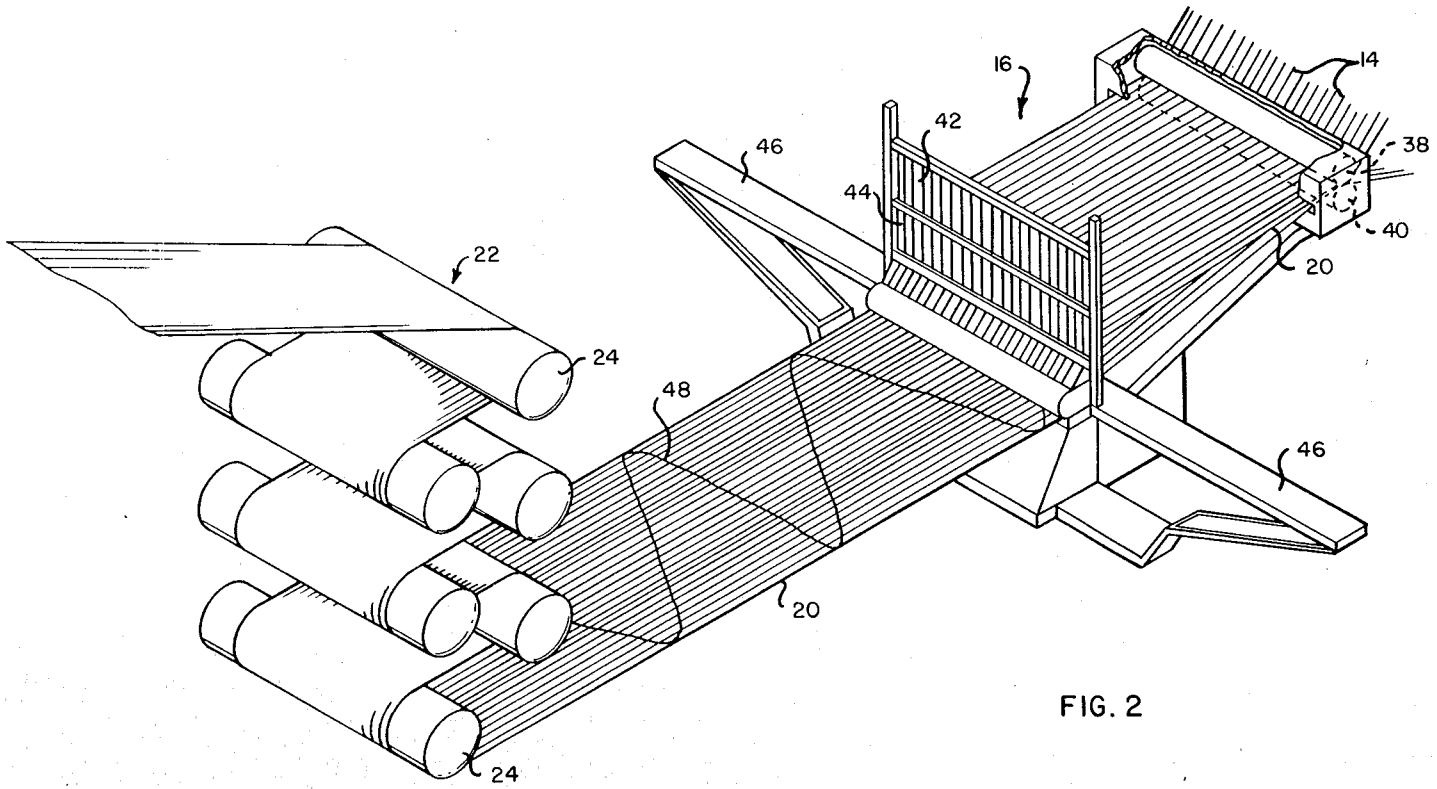
FIG. 2 is a perspective view of portions of the fill yarn inserter and adjacent tension stand of the apparatus of FIG. 1.

The arrangement shown in FIG. 1 is conventional in nature and utilizes components which are known in the art. FIG. 2 illustrates in greater detail a portion of the arrangement of FIG. 1 including in particular the fill yarn inserter 16 and the tension stand 22. As seen in FIG. 2 the individual tows 14 which are drawn through the combs 18 from the creels 12 are drawn between a pair of opposite rollers 38 and 40 where the web 20 is formed. As described in previously referred to U.S. Pat. No. 4,173,990, alternate ones of the tows 14 traveling between the rollers 38 and 40 are separated from remaining ones of the tows 14 by heddles 42 and 44 forming a part of the fill yarn inserter 16. A rapier assembly 46 inserts a fill yarn 48 between the separated tows 14 just prior to the separated tows 14 again being converged into a single plane to reform the web 20 complete with the fill yarn 48. As seen in FIG. 2 the fill yarn 48 alternates back and forth across the width of the web 20 in zig-zag fashion.

In conventional processes the web 20 is introduced into the oxidation ovens 26 and 28 of the assembly 30 by being fed through the ovens 26 and 28 while the ovens are cool. The ovens 26 and 28 are then turned on and heated to the oxidizing temperatures as the web 20 continues to be pulled through the ovens 26 and 28. When the ovens 26 and 28 reach the desired oxidizing temperatures portions of the web 20 subsequently entering the oven 26 and eventually the oven 28 are oxidized in the desired fashion. Those portions of the web 20 which have already been fed into or through the ovens 26 or 28 must be considered wastage.

In the event that the ovens 26 and 28 are cooled off and stopped with a web of carbonizable tows remaining therein and it is desired to commence feeding a new length of web of carbonizable tows through the ovens, the individual tows of the new length of web may be tied to the individual tows of the web residing within the ovens 26 and 28. The tying is effected just outside of an entrance 50 to the first oven 26. The web within the ovens 26 and 28 is then used to pull the new web into and through the oven 26 and then the oven 28. Heating of each different stage within the ovens 26 and 28 is begun after the knots within the tied tows have passed through that particular stage. Again, the web residing within the ovens 26 and 28 initially and the portions of the new web which are drawn through the ovens 26 and 28 prior to the ovens reaching the desired oxidizing temperatures must be discarded as wastage.

Figure 3:
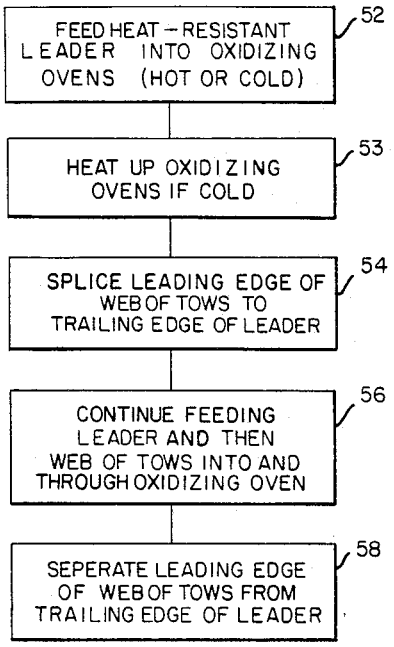
FIG. 3 is a block diagram of the successive steps in methods according to the invention.

FIG. 3 sets forth the successive steps in methods according to the invention. Such methods serve to greatly reduce or eliminate the wastage of large portions of the web of carbonizable tows when starting up the system of FIG. 1 and introducing the web into the oxidizing ovens 26 and 28. This is accomplished by initially running a leader in the form of an elongated web of heat-resistant material through the oxidizing ovens 26 and 28 and then splicing a trailing edge of the leader to a leading edge of the web of tows to be oxidized. The leader is then used to pull the web of tows through the ovens 26 and 28 where the tows of the web are oxidized in desired fashion. When the leading edge of the web of tows has cleared the tension stand 35 adjacent the exit end of the second oven 28, such end may be separated from the trailing edge of the leader. The use of a heat-resistant leader enables the ovens 26 and 28 to be heated to oxidizing temperatures before the web of carbonizable tows is started into and through the ovens, thereby minimizing or eliminating wastage of the carbonizable tows.

As shown by a first step 52 in FIG. 3 the heat-resistant leader comprising an elongated web of heat-resistant material such as silica or aramid cloth is fed into the oxidizing ovens 26 and 28 until the leader has passed completely or substantially completely through the ovens with the trailing edge thereof remaining outside of and adjacent the entrance 50 to the oven 26. In a second step 53 the oxidizing ovens 26 and 28 are heated up to oxidizing temperatures if they are not already so heated. In a third step 54 the leading edge of the web 20 formed by the tows 14 and provided by the fill yarn inserter 16 is spliced to the trailing edge of the leader. In a fourth step 56 feeding of the leader through the ovens 26 and 28 is continued so that the web 20 is fed into and then through the oxidizing ovens 26 and 28. When the leading edge of the web 20 of carbonizable tows 14 has passed all the way through both ovens 26 and 28 and the tension stand 35, then in a fifth step 58 such leading edge may be separated from the trailing edge of the leader.

In accordance with the method set forth in FIG. 3, the heat-resistant leader can be fed into the ovens 26 and 28 when the ovens have already been heated to the oxidizing temperatures. The leader can remain at rest within the heated ovens 26 and 28 without being adversely affected. In a more typical situation where the apparatus shown in FIG. 1 is to be shut down for a period of time, the heat-resistant leader is fed into the ovens 26 and 28 as the process is being shut down and the ovens cooled. Upon subsequent startup of the process, the ovens 26 and 28 are brought up to oxidizing temperatures while the heat-resistant leader remains at rest therein. In the meantime the trailing edge of the leader may be spliced to the leading edge of the web 20 so that upon reaching the oxidizing temperatures the leader and then the web 20 can be advanced through the ovens 26 and 28.

Figure 4:
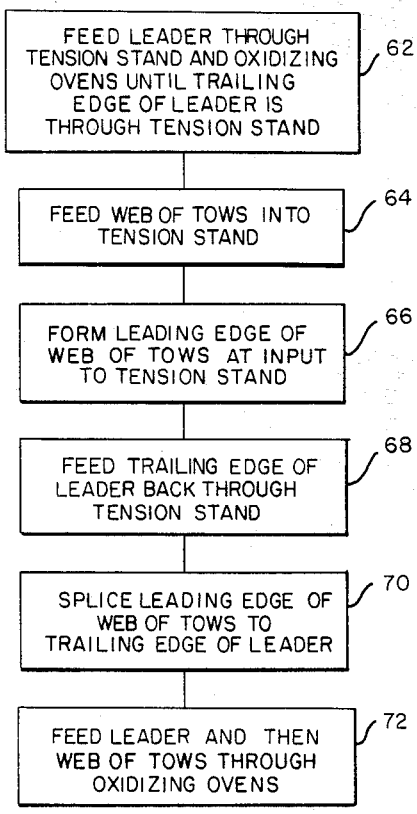
FIG. 4 is a block diagram of the successive steps in a detailed example of the methods of FIG. 3 utilizing the apparatus of FIG. 1.

FIG. 4 sets forth the successive steps of a detailed method in accordance with the methods of FIG. 3. In a first step 62 in the method of FIG. 4 a heat-resistant leader is fed through the tension stand 22 and the oxidizing ovens 26 and 28 until the trailing edge thereof has passed through the tension stand 22 and resides outside of and adjacent the entrance 50 to the oven 26. In a second step 64 the web 20 comprised of the tows 14 is fed into the tension stand 22. In a third step 66 a leading edge is formed in the web 20 adjacent the input to the tension stand 22. The feeding of the web 20 into the tension stand prior to the formation of a leading edge in the web 20 serves to hold the web 20 relatively taut between the fill yarn inserter 16 and the tension stand 22 so that formation of the leading edge is thereby facilitated. This will be better appreciated in light of the subsequent discussion in connection with FIGS. 5–11 which contain a detailed example of how such leading edge can be formed.

In a fourth step 68 in the method of FIG. 4 the trailing edge of the leader which is residing adjacent the entrance 50 to the first oxidizing oven 26 is fed back through the tension stand 22 so as to dispose it adjacent the leading edge of the web 20. In a fifth step 70 the leading edge of the web 20 is spliced to the trailing edge of the leader between the fill yarn inserter 16 and the tension stand 22. In a sixth step 72 the feeding of the leader through the oxidizing ovens 26 and 28 is continued. The attached web 20 is fed through the tension stand 22 and then through the first oxidizing oven 26 and the second oxidizing oven 28. Although not specifically set forth in FIG. 4, the leading edge of the web 20 is unspliced from or separated from the trailing edge of the leader after the leading edge of the web 20 has passed through the ovens 26 and 28 and the tension stand 35 as set forth in the fourth step 58 of FIG. 3.

Figure 5:
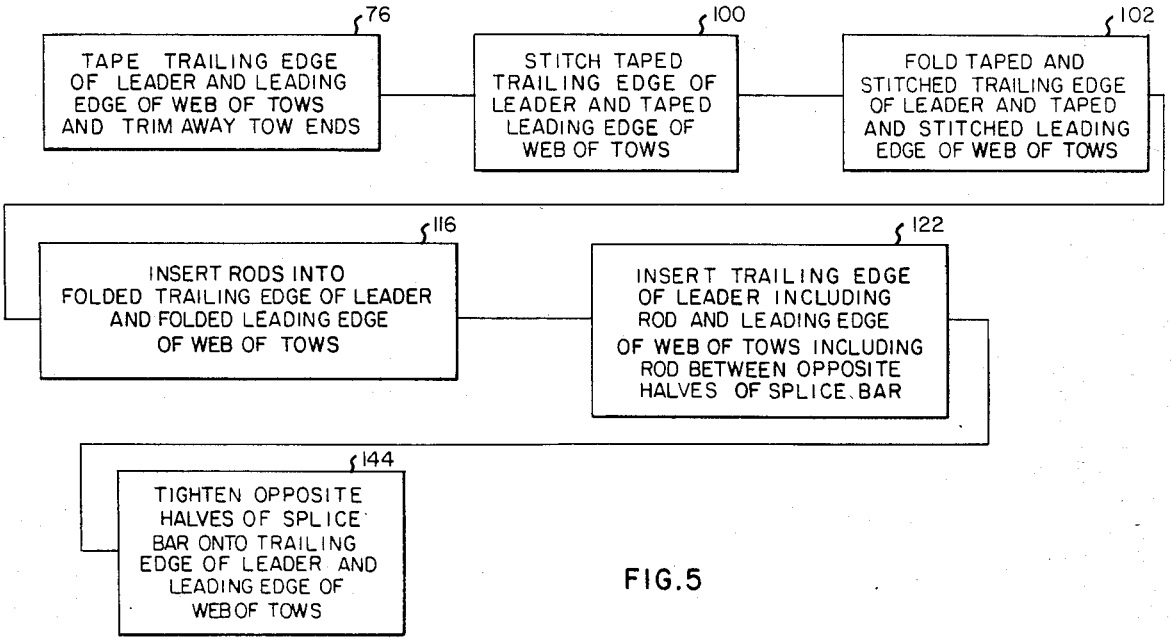
FIG. 5 is a block diagram of the successive steps used in a particular method of splicing which may be utilized in the methods of FIG. 3.
Figure 6:
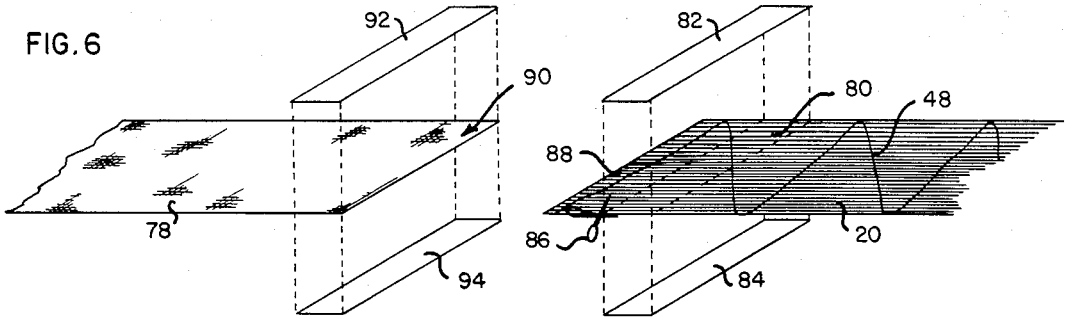
FIG. 6 is a perspective view of the edges of a leader and a web of carbonizable tows showing the application of tape thereto and the trimming of the web in accordance with the method of FIG. 5.

The successive steps of a particular method of splicing the leading edge of the web 20 to the trailing edge of the leader are set forth in FIG. 5. The various steps of FIG. 5 are illustrated in FIGS. 6–10 with the completed splice being shown in FIG. 11. In a first step 76 shown in FIG. 5 the trailing edge of the leader is taped and the leading edge of the web 20 is taped and trimmed. This step is illustrated in FIG. 6 which shows the web 20 together with a leader 78. In the second step 64 of FIG. 4 the web 20 is fed into the tension stand 22. In the next step 66 of FIG. 4 a leading edge is formed in the web 20 adjacent the input to the tension stand 22. As illustrated in FIG. 6 the individual tows 14 of the web 20 extend between the fill yarn inserter 16 and the tension stand 22. At a convenient location 80 across the width of the web 20 adjacent the input to the tension stand 22 two lengths of heat-resistant tape 82 and 84 of silica or similar composition are applied to the opposite sides of the web 20 across the width of the web 20. The tape lengths 82 and 84 are applied so as to lie essentially opposite each other on the opposite surfaces of the web 20. As illustrated by a pair of shears 86 in FIG. 6 the tows 14 are cut adjacent the tape lengths 82 and 84 on the sides thereof adjacent the tension stand 22. This results in a plurality of loose lengths 88 of the tows 14 extending out of the entrance to the tension stand 22. These lengths 88 are removed from the tension stand 22 and discarded.

In the fourth step 68 depicted in FIG. 4 the trailing edge of the leader which lies between the tension stand 22 and the entrance 50 to the first oxidizing oven 26 is fed back through the tension stand 22. In the next step 70 the leading edge of the web 20 is spliced to the trailing edge of the leader. As shown in FIG. 6 the leader 78 has a trailing edge 90 which is assumed to have been fed back through the tension stand 22 in preparation for splicing to the leading edge of the web 20. Lengths of tape 92 and 94 are applied to the opposite surfaces of the leader 78 across the width thereof at the trailing edge 90.

Figure 7:
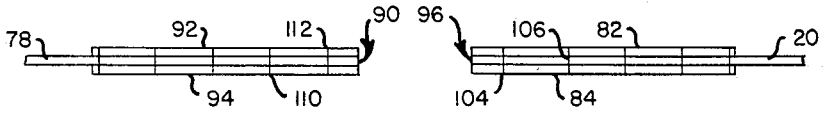
FIG. 7 is an end view of the edges of the leader and the web of FIG. 6 upon application of the tape and trimming of the web and following stitching along the tape.

The web 20 as taped and cut is shown in FIG. 7. The cutting of the loose lengths 88 of the tows 14 provides the web 20 with a leading edge 96. The trailing edge 90 of the leader 78 is also shown in FIG. 7 with the opposite lengths of tape 92 and 94 applied thereto.

In a second step 100 of FIG. 5 the trailing edge 90 of the leader 78 and the leading edge 96 of the web 20 are stitched several times along the lengths of tape 82, 84, 92 and 94. In the present example each of the edges 90 and 96 is stitched five times along the width thereof as illustrated in FIG. 7. Each stitching penetrates the thickness of the leader 78 or the web 20 and the two lengths of tape on the opposite surfaces thereof. The two stitchings closest the leading edge 96 of the web 20 are illustrated as 104 and 106 in FIGS. 7–9. The two stitchings closest the trailing edge 90 of the leader 78 are designated 110 and 112 in FIGS. 7–9.

Figure 8:
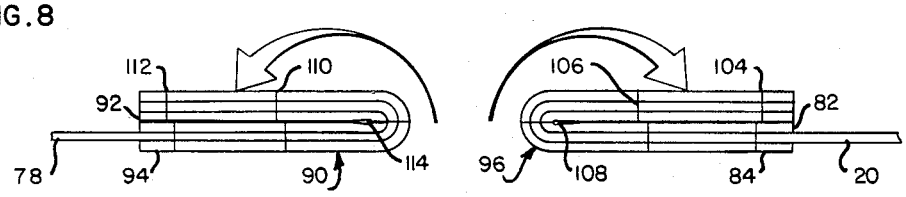
FIG. 8 is an end view of the edges of the leader and the web of FIG. 6 after the edges of the leader and the web are folded over on themselves to form loops therein.

FIG. 8 illustrates the results of a third step 102 in FIG. 5 in which the edges 90 and 96 are folded over upon themselves. This forms a loop 108 in the leading edge 96 of the web 20 and a loop 114 in the trailing edge 90 of the leader 78.

Figure 9:
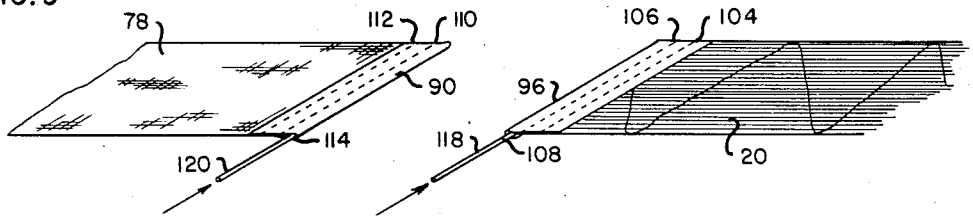
FIG. 9 is a perspective view of the edges of the leader and the web of FIG. 6 showing insertion of elongated rods into loops formed at the edges in accordance with the method of FIG. 5.

In a fourth step 116 shown in FIG. 5 rods are inserted into the trailing edge of the leader and the leading edge of the web. This is illustrated in FIG. 9 in which an elongated rod 118 is shown being inserted into the loop 108 in the leading edge 96 of the web 20. FIG. 9 also shows an elongated rod 120 being inserted into the loop 114 formed in the trailing edge 90 of the leader 78.

Figure 10:
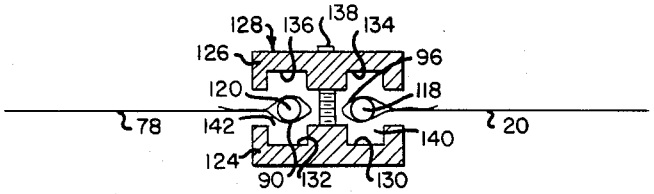
FIG. 10 is an end view of the edges of the leader and the web of FIG. 6 showing the manner in which the edges and included elongated rods are inserted between the opposing halves of a splice bar in accordance with the method of FIG. 5.
Figure 11:
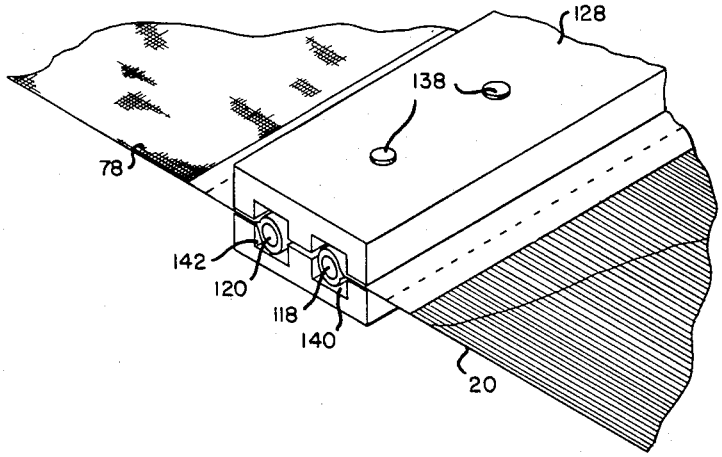
FIG. 11 is a perspective view of the edges of the leader and the web of FIG. 6 and the splice bar of FIG. 10 showing the completed splice.

In a fifth step 122 shown in FIG. 5 the trailing edge of the leader with included rod and the leading edge of the web with included rod are inserted between the opposite halves of a splice bar. This step is illustrated in FIG. 10 in connection with the opposite halves 124 and 126 of a splice bar 128. The splice bar half 124 has a pair of grooves 130 and 132 in the surface thereof facing the opposite half 126. The opposite half 126 has a pair of grooves 134 and 136 on the inside surface thereof. When the opposite halves 124 and 126 of the splice bar 128 are drawn together by a plurality of screws 138 extending between the opposite halves 124 and 126 along the length of the splice bar 128, the grooves 130 and 134 form a slot 140 for receiving the leading edge 96 of the web 20 including the rod 118. In similar fashion the grooves 132 and 136 form a slot 142 for receiving the trailing edge 90 of the leader 78 including the rod 120. The edges 90 and 96 are secured within the splice bar 128 in a sixth step 144 shown in FIG. 5 in which the screws 138 are employed to tighten the opposite halves 124 and 126 onto the web 20 and the leader 78. The resulting splice is shown in FIG. 11.

In cases where the leader 78 was previously taped, stitched and folded as illustrated in FIGS. 6–8, splicing of the leader 78 to the web 20 may only require preparation of the web 20 according to the steps of FIGS. 6–8 prior to insertion of the rods 110 and 120 into the loops 108 and 114 in preparation for insertion in the splice bar 128.

The splice of the web 20 to the leader 78 is very strong and capable of withstanding the tension exerted on the leader 78 and the web 20 as the two are pulled through the tension stand 22 and the oxidizing ovens 26 and 28. At the same time the splice formed by the splice bar 128 is relatively flat and compact so as to be readily capable of negotiating the relatively tortuous paths through the oxidizing ovens 26 and 28. The splice bar 128 and the rods 118 and 120 which are preferably made of aluminum or steel are capable of withstanding the relatively high temperatures within the ovens 26 and 28. Most importantly, the cut ends of the tows 14 within the web 20 are essentially covered by the lengths of tape 82 and 84 and are completely contained within the splice bar 128 so as to prevent any exotherming when the splice is within the ovens 26 and 28. The lengths of tape 82 and 84 also serve to separate the individual tows at the fold where the loop 108 is formed, preventing the buildup of a tow mass which could cause exotherming.

It should be understood that the particular splice shown and described in FIGS. 5–11 comprises one example only, and that other splices may be used in methods according to the invention. Another example of a splice which may be used is described in a co-pending application of Fernandez et al, Ser. No. 483,780, filed April 11, 1983, and commonly assigned with the present application.

While the invention has been particularly shown and described with reference to preferred embodiments thereof, it will be understood by those skilled in the art that various changes in form and details may be made therein without departing from the spirit and scope of the invention.

What is claimed is:

1. A method of introducing an elongated web of heat-sensitive material into an oven under tension in an arrangement in which the elongated web is generally continuously fed into and through a complex path within the oven comprising the steps of:

feeding a leader in the form of an elongated web of heat-resistant material through at least a substantial portion of the complex path within the oven so that a trailing edge thereof remains outside of the oven and a nominal amount of tension is established in the leader;

providing an elongated web of heat-sensitive material adjacent the oven, the web of heat-sensitive material having a leading edge;

splicing the trailing edge of the leader to the leading edge of the web of heat-sensitive material; and continuing to feed the leader and then the web of heat-sensitive material into and through the oven.

2. The invention set forth in claim 1, comprising the further step of separating the trailing edge of the leader from the leading edge of the web of heat-sensitive material after the leading edge of the web of heat-sensitive material has passed all of the way through the oven.

3. The invention set forth in claim 1, wherein the oven is cool when the leader is fed through at least a substantial portion of the complex path within the oven and is heated prior to the step of continuing to feed the leader and then the web of heat-sensitive material into and through the oven.

4. The invention set forth in claim 1, wherein the step of splicing the trailing edge of the leader to the leading edge of the web of heat-sensitive material includes the steps of taping, stitching and folding the trailing edge of the leader and the leading edge of the web of heat-sensitive material, inserting rods into the trailing edge of the leader and the leading edge of the web of heat-sensitive material and inserting the trailing edge of the leader and the leading edge of the web of heat-sensitive material including the rods into a splice bar.

5. A method of introducing an elongated web of carbonizable tows into an oxidizing oven arrangement under tension in a process for continuously feeding the web through the oven arrangement to oxidize the carbonizable tows comprising the steps of:

feeding an elongated leader of heat-resistant material having a trailing edge into an entrance of and through the oxidizing oven arrangement so that the trailing edge remains outside of the entrance to the oxidizing oven arrangement;

providing an elongated web of carbonizable tows having a leading edge;

splicing the trailing edge of the leader to the leading edge of the web of carbonizable tows; and continuing to feed the leader and then the web of carbonizable tows into the entrance of and through the oxidizing oven arrangement.

6. The invention set forth in claim 5, wherein the oxidizing oven arrangement is heated to a desired oxidizing temperature range prior to the feeding of the leader therethrough and remains at the desired oxidizing temperature range during the steps of splicing and continuing to feed the leader and then the web of carbonizable tows into the entrance of and through the oxidizing oven arrangement.

7. The invention set forth in claim 5, wherein the oxidizing oven arrangement is cool during the feeding of the leader into the entrance of and through the oxidizing oven arrangement and is then heated to a desired oxidizing temperature range prior to the step of continuing to feed the leader and then the web of carbonizable tows into the entrance of and through the oxidizing oven arrangement.

8. The invention set forth in claim 5, wherein the step of splicing includes the steps of:

forming loops in the trailing edge of the leader and the leading edge of the web;

inserting elongated objects into the loops in the trailing edge of the leader and the leading edge of the web; and securing an elongated splice bar over the trailing edge of the leader and the leading edge of the web including the elongated objects therein.

9. The invention set forth in claim 8, wherein the step of forming loops in the trailing edge of the leader and the leading edge of the web includes the steps of:

applying a pair of tape lengths to opposite sides of the trailing edge of the leader and a pair of tape lengths to opposite sides of the leading edge of the web;

trimming away portions of the web beyond the pair of tape lengths applied thereto;

stitching along the taped trailing edge of the leader and the taped leading edge of the web; and folding the trailing edge of the leader onto itself and the leading edge of the web onto itself.

10. A method of introducing an elongated web of carbonizable tows from a tension stand into an oxidizing oven comprising the steps of:

feeding a leader comprised of a length of cloth of high temperature resistant material having a trailing edge through the tension stand and the oxidizing oven until the leader extends through the oxidizing oven and the trailing edge has passed through the tension stand;

feeding a web of carbonizable tows at least partly into the tension stand;

forming a portion of the web at the input to the tension stand into a leading edge for the web;

feeding the trailing edge of the leader back through the tension stand until the trailing edge is at the input to the tension stand;

splicing the trailing edge of the leader to the leading edge of the web; and continuing to feed the leader and the attached web through the tension stand and the oxidizing oven.

11. The invention set forth in claim 10, including the further step of detaching the leading edge of the web from the trailing edge of the leader after the leading edge of the web has passed through the oxidizing oven.

* * * * *